United States Patent [19]

Farng et al.

[11] Patent Number: 4,828,740

[45] Date of Patent: May 9, 1989

[54] MIXED HYDROQUINONE-HYDROXYESTER BORATES AS ANTIOXIDANTS

[75] Inventors: Liehpao O. Farng, Lawrenceville; Andrew G. Horodysky, Cherry Hill, both of N.J.

[73] Assignee: Mobil Oil Corporation, New York, N.Y.

[21] Appl. No.: 78,949

[22] Filed: Jul. 29, 1987

[51] Int. Cl.[4] ..... C10M 139/00

[52] U.S. Cl. ..... 252/49.7; 252/49.6; 423/277; 558/294; 558/296

[58] Field of Search ..... 252/49.6, 49.7; 558/296, 294; 423/277

[56] References Cited

U.S. PATENT DOCUMENTS

| | | | |
|---|---|---|---|
| 2,652,361 | 9/1953 | Woods et al. | 252/49.7 |
| 2,979,459 | 4/1961 | Darling et al. | 252/49.6 |
| 3,533,945 | 10/1970 | Vogel | 252/49.6 |
| 4,233,735 | 9/1980 | Caldwell, Jr. et al. | 423/242 A |
| 4,295,983 | 10/1981 | Papay et al. | 252/49.6 |
| 4,370,248 | 1/1983 | Horodysky et al. | 252/49.6 |
| 4,455,243 | 6/1984 | Liston | 252/49.7 |
| 4,568,472 | 2/1986 | Horodysky et al. | 252/49.6 |
| 4,594,171 | 6/1986 | Horodysky et al. | 252/51.5 R |
| 4,652,387 | 3/1987 | Andress, Jr. et al. | 252/51.5 A |
| 4,683,069 | 7/1987 | Brewster et al. | 252/51.5 A |

FOREIGN PATENT DOCUMENTS

| | | | |
|---|---|---|---|
| 1287444 | 8/1972 | United Kingdom | 252/49.7 |

*Primary Examiner*—William R. Dixon, Jr.
*Assistant Examiner*—Margaret B. Medley
*Attorney, Agent, or Firm*—Alexander J. McKillop; Charles J. Speciale; Howard M. Flournoy

[57] ABSTRACT

Mixed hydroquinones-hydroxyester borates have been found to be effective multifunctional additives when incorporated into various lubricating media.

20 Claims, No Drawings

MIXED HYDROQUINONE-HYDROXYESTER BORATES AS ANTIOXIDANTS

BACKGROUND OF THE INVENTION

This application is directed to lubricant compositions containing small additive concentrations of mixed hydroquinone-hydroxyester borates having excellent multifunctional/antioxidant activity.

The use of hydroquinones has been well known for their antioxidant properties in a variety of petroleum and non-petroleum products. The use of borates has found extensive application in such diverse areas as grease additives, brake and hydraulic fluids, and fuel and combustion additives. The use of hydroxyesters has been widely reported as having beneficial multifunctional characteristics in a variety of fuel and lubricant applications.

It has now been found that the use of these novel mixed hydroquinone-hydroxyester borates provide exceptional antioxidant and corrosion inhibiting activity with the potential for antifatigue, friction reducing, antirust and high temperature stabilizing properties. These novel borates are also highly useful not only in oils of lubrication viscosity but also in solid lubricants such as greases.

SUMMARY OF THE INVENTION

U.S. Pat. Nos. 4,594,171 and 4,568,472 disclose the use of borated additive compounds such as borated hydroxyesters in lubricant compositions. U.S. Pat. No. 4,645,082 discloses the use of hydroquinones as an antioxidant in ink compositions. U.S. Pat. No. 4,223,735 discloses the use of of hydroquinone as an oxidation inhibitor in a method of producing petroleum.

Lubricant compositions containing small additive concentrations of mixed hydroquinone-hydroxyester borates such as hydroquinone-glycerol monoleate borates possess excellent antioxidant activity. Although not wishing to be bound by a particular theory both the hydroquinone moiety and the borate ester are believed to provide the basis for synergistic antioxidant activity, the hydroxyester is believed to contribute additional antirust and/or friction reducing properties to the additives. These beneficial properties are believed to be enhanced as a result of this novel internal synergism. This internal synergism concept is believed to be applicable to similar structures containing hydroquinone, borate ester and hydroxyester (preferably diol containing) moieties within the same molecule. The products disclosed herein also show good compatibility when used in the presence of other additives in the lubricant compositions.

DESCRIPTION OF PREFERRED EMBODIMENTS

Hydroquinone is for example co-borated with glycerol monooleate (60% glycerol monooleate, 40% glycerol dioleate) to form mixed borate esters having the structure, as generally described below:

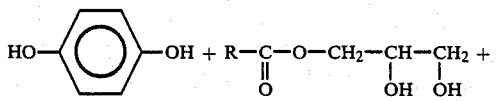

-continued

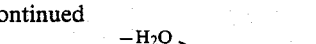

where R is $C_8$–$C_{20}$ hydrocarbyl and y is the boronating agent.

Other appropriate hydroxyesters can be more generally described as:

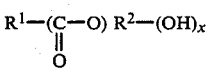

or

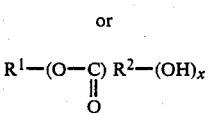

where x is equal to 1 to 2 and where $R^1$ and $R^2$ are each independently $C_8$–$C_{20}$ hydrocarbyl. An excess of one reagent or another can be used. Molar quantities, less than molar quantities, or more than molar quantities of a boronating agent can be used. Boric acid can be used as a boronating agent or metaborates, trialkyl borates or any other suitable boronating agent may be employed.

The generalized structure of the hydroxyesters, useful herein before boration, is exemplified by the following:

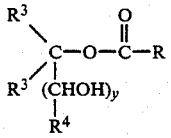

Where $R^3$=$CH_2OH$, $CH_3$ or H $R^4$=$CH_2OH$, H, or $CR^2$ OCOR y=1 to 5

The hydroxy esters must contain at least one free hydroxyl group but may contain two or more. The hydroxy esters may also contain one ester group (as is glycerol monooleate) or more (as in glycerol dioleate). The esters can be used in pure form, or preferably in mixtures such as mixtures of glycerol mono- and dioleate. R is a hydrocarbyl group having from about 8 to about 20 carbon atoms and said hydrocarbyl moiety may be alkyl, straight or branched, cyclic or substituted; and may contain one or more double bonds, halogen or one or more sulfur atoms or aromatic rings and y is 1 to about 5. The hydroxy esters may be made by the reaction of polyhydroxy alcohols with organic acids where glycerol and oleic acid are used in the preparation of glycerol monooleate. Thioglycerol hydroxyesters can also be used.

Sorbitan hydroxyesters and hydroxyesters prepared from trimethylolpropane and pentaerythritol aare also useful, e.g., sorbitan monooleate, trimethylolpropane monooleate, trimethylolpropane dioleate, pentaerythritol dioleate monolaurate and the like.

Typical hydroquinones which may be employed include, among others: 2,5-ditertiary butyl hydroquinone; hydroquinone monomethyl ether; monotertiary butyl hydroquinone; hydroquinone; and hydroquinone monobenzyl ether.

The borated derivatives are convenieently produced by the reaction of the selected mixture of compounds with, for example, boric acid, in the presence of a suitable solvent or solvents at temperatures ranging from about 110° C. to about 280° C. Specific reactor conditions and molar equivalents vary with the various reactants and can be readily determined by one of ordinary skill in the art. Besides direct treatment with boric acid other boration procedures several of which are well known in the art can be used, for example, transecterification with a trialkyl borate such as tributyl borate. In any event, the boration procedure generally adopted is conveniently a one-pot, one-step process. The resulting borated mixed materials provided as noted previously and containing from 12 to 48 or more carbon atoms are much more effective as antioxidant/friction reducing lubricant additives than their non-borated counterparts or physical mixtures of the individual borated materials.

The borated mixed materials possess antioxidant and corrosion inhibiting properties not generally found in the non-borated material and are superior to equivalent physical mixtures of the individual borated materials. The higher molecular weight borated mixtures also appear to be relatively resistant to hydrolysis and retain their multifunctional characteristics even after being in the presence of water at elevated temperatures.

The molar rating of the respective reactants may be conveniently generalized as follows: 1-20: 0.1-10: 0.1-5 and preferably 1:1:1 of hydroxyester to hydroquinone to boronating substance (boric acid for example). Other reaction conditions may be summarized as follows: the reaction temperatures are preferably from about 80° to 135° C. and the pressure is preferably ambient or autogenus.

EXAMPLES

Example 1

Approximately 178 g commercial glycerol monooleate, 55 g hydroquinone, 31 g boric acid and 200 ml toluene were mixed in a reactor equipped with heater, agitator and Dean-Stark tube with condenser. The reactants were heated at 114° C. over a period of six hours during which 25 g water was collected during azeotropic distillation. The solution was filtered to remove 1.0 g solids and the volatiles were removed by distillation at reduced pressure.

Evaluation

Selected samples of the mixed hydroquinone-hydroxyester borates were blended into fully formulated oils and evaluated for antioxidant performance in a Catalytic Oxidation Test at 325° F. for 40 hours (Table 1); Catalytic Oxidation Test at 260° F. for 80 hours (Table 2); and Catalytic Oxidation Test at 375° F. for 24 hours (Table 3). The test lubricant composition is subjected to a stream of air which is bubbled through the composition at a rate of 5 liters per hour. Present in the composition comprising a 150 second solvent refined paraffinic bright oil in addition to the additive compound were metals commonly used as materials to construct engines namely:

(a) 15.6 sq. in. of sand-blasted iron wire;
(b) 0.78 sq. in. of polished copper wire;
(c) 0.87 sq. in. of polished aluminum wire; and
(d) 0.107 sq. in. of polished lead surface.

The test results are reported below in the tables.

A comparison of the oxidation-inhibiting characteristics of the inventive products with the other traditional antioxidants in fully formulated oils is also included in Table 1.

TABLE 1

| | Catalytic Oxidation Test 40 Hours at 325° F. | | | |
|---|---|---|---|---|
| | Additive Conc. (Wt. %) | Percent Change in Acid Number TAN | Percent Change in Viscosity KV | Sludge |
| Base Oil (150 second, fully formulated, solvent refined paraffinic bright oil containing defoamant/demulsifier/antiwear/anticorrosion/EP/antirust performance package | — | 2.58 | 30.61 | Nil |
| Example 1 | 1.0 | 1.78 | 26.47 | Trace |
| Hydroquinone | 0.1* | 1.99 | 27.92 | Trace |
| Hydroquinone Borate | 0.1* | — | 26.79 | Trace |

*Maximum Solubility

TABLE 2

| | Catalytic Oxidation Test 80 Hours at 260° F. | | | |
|---|---|---|---|---|
| | Additive Conc. (Wt. %) | Percent Change in Acid Number TAN | Percent Change in Viscosity KV | Sludge |
| Base Oil (150 second, fully formulated, solvent refined paraffinic bright oil containing defoamant/demulsifier/antiwear/anticorrosion/EP/antirust performance package | — | 0.01 | 6.48 | Nil |
| Example 1 | 1.0 | −0.25 | 5.27 | Nil |

TABLE 3

| | Catalytic Oxidation Test 24 Hours at 375° F. | | | |
|---|---|---|---|---|
| | Additive Conc. (Wt. %) | Percent Change in Acid Number TAN | Percent Change in Viscosity KV | Sludge |
| Base Oil (150 second, fully formulated, solvent refined paraffinic bright oil containing defoamant/demulsifier/antiwear/anticorrosion/EP/antirust performance package | — | 6.53 | 177.9 | Medium |
| Example 1 | 1.0 | 3.68 | 83.5 | Medium |

As shown above, the products of this invention show very good antioxidant activity as evidenced by control of increase in acidity and viscosity, especially under the very severe conditions shown in Table 3. The products of this invention when used in premium quality automotive and industrial lubricants will significantly enhance the stability and extend the service life. These concentrations and do not contain any potentially undesirable metals or chlorine and are ashless. These multifunctional antioxidants can be commercially made by using an economically favorable process which could be readily implemented using known technology in existing equipment.

Although the present invention has been described with preferred embodiments, it is to be understood that modifications and variations may be resorted to, without departing from the spirit and scope of this invention, as those skilled in the art will readily understand. Such modifications and variations are considered to be within the purview and scope of the appended claims.

We claim:

1. A composition comprising a major proportion of an oil of lubricating viscosity or grease or other solid lubricant prepared therefrom and a minor effective amount of a multifunctional friction reducing, antirust and antioxidant additive selected from mixed hydroquinone-hydroxyester borates and wherein said additive is prepared in reactions as generally described below:

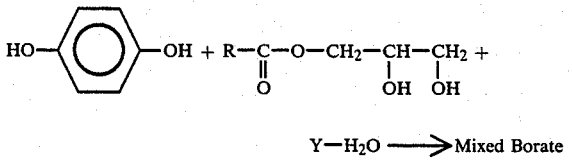

at temperatures varying from 80° to about 135° C. under ambient or autogenous pressure in molar ratios of hydroxyester to hydroquinone to borating agent of from 1-20:0.1-10:0.1-5 and where R is $C_8$-$C_{20}$ hydrocarbyl and Y is said boronating agent.

2. The composition of claim 1 wherein the boronating agent is selected form the group consisting of boric acid, metaborates and trialkyl borates.

3. The composition of claim 1 wherein said ester is a mixture of glycerol monooleate and glycerol dioleate.

4. The composition of claim 2 wherein said ester is a mixture of glycerol monooleate and glycerol dioleate.

5. The composition of claim 3 wherein said hydroquinone and said hydroxyesters are reacted with boric acid.

6. The composition of claim 4 wherein said hydroquinone and said hydroxyesters are reacted with boric acid.

7. The composition of claim 1 wherein said ester is glycerol monooleate.

8. The composition of claim 1 wherein said ester is glycerol dioleate.

9. The composition of claim 1 wherein said oil is selected from mineral oils, synthetic oils and mixtures thereof.

10. The composition of claim 1 wherein said oil is a synthetic oil.

11. The composition of claim 1 wherein said oil is a mineral oil.

12. The composition of claim 1 wherein said oil is a mixture of synthetic and mineral oils.

13. The composition of claim 1 wherein said major proportion comprises a grease.

14. An additive product prepared by reacting mixed hydroquinone hydroxyester with a suitable boronating agent in less than, more than or molar quantities and with less than molar quantities or more than molar quantities of a hydroxyester and molar amounts, less than molar amounts and more than molar amounts of a suitable boronating agent under temperatures varying from 80° to about 135° C. and under ambient or autogenous pressure in the reaction generally described below:

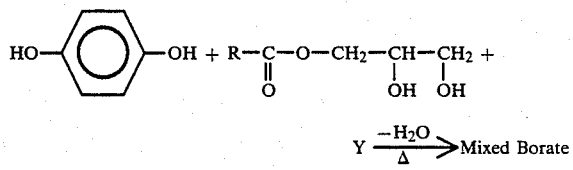

where R is $C_8$-$C_{20}$ hydrocarbyl and Y is the boronating agent.

15. The product of claim 14 wherein the hydroxyester before boration has the following general structural formula:

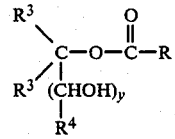

Wherein $R^3$ is $CH_2OH$, $CH_3$ or H $R^4$ is $CH_2OH$, H, or $CR^2OCOR$ y is 1 to 5

R and $R^2$ are each independently selected from $C_8$ to about $C_{20}$ hydrocarbyl.

16. The additive of claim 15 wherein the hydroxyester is selected from glycerol monooleate, glycerol dioleate and a mixture of glycerol monooleate, and glycerol dioleate.

17. The additive of claim 16 wherein the hydroxyester is glycerol monooleate.

18. The additive of claim 16 wherein the hydroxyester is glycerol dioleate.

19. The additive product of claim 14 wherein the boronating agent is selected from the group consisting of boric acid, metaborates, and trialkyl borates.

20. The additive product of claim 19 wherein the reactants are hydroquinone, a mixture of monooleated glycerol and dioleated glycerol and boric acid.

* * * * *